US005501785A

United States Patent [19]

Nakayama

[11] Patent Number: 5,501,785

[45] Date of Patent: Mar. 26, 1996

[54] PROCESS FOR MANUFACTURING ELECTROFORMED PATTERNS

[75] Inventor: Hiroo Nakayama, Yokosuka, Japan

[73] Assignee: Tefco International Co., Ltd., Japan

[21] Appl. No.: 373,555

[22] Filed: Jan. 17, 1995

[30] Foreign Application Priority Data

Jul. 13, 1994 [JP] Japan ..... 6-161597
Oct. 13, 1994 [JP] Japan ..... 6-248192

[51] Int. Cl.[6] ..... C25D 1/00
[52] U.S. Cl. ..... 205/67; 205/72
[58] Field of Search ..... 205/67, 70, 72

[56] References Cited

U.S. PATENT DOCUMENTS 4,462,873 7/1984 Watanabe ..... 204/4
4,584,039 4/1986 Shea ..... 156/150

FOREIGN PATENT DOCUMENTS 157508 10/1985 European Pat. Off. ..... H01L 21/68
493909 7/1992 European Pat. Off. ..... G01S 7/52
33909 7/1983 Japan ..... C09J 3/14
3-14263 1/1991 Japan .
43988 7/1991 Japan ..... C25D 1/00
54068 11/1992 Japan ..... C09J 7/02

*Primary Examiner*—John Niebling
*Assistant Examiner*—Brendan Mee
*Attorney, Agent, or Firm*—Webb Ziesenheim Bruening Logsdon Orkin & Hanson

[57] ABSTRACT

The process for manufacturing electroformed patterns according to the present invention comprises: forming electroformed patterns and an electroformed line surrounding said patterns (and optionally an electroformed island) on a surface of a conductive substrate; peeling the electroformed patterns and the electroformed line (and optionally an electroformed island) from the conductive substrate to transfer them onto a pressure-sensitive adhesive layer provided on a support; forming a firmly bonding adhesive layer on the whole surface of the side where the electroformed patterns and the electroformed line (and optionally an electroformed island) are retained; removing the electroformed line (and optionally an electroformed island); and adhering the electroformed patterns to a surface of an adherend through the firmly bonding adhesive layer, simultaneously with separating the electroformed patterns from the support. According to this invention, the electroformed patterns can be manufactured at a low cost. Further, the electroformed patterns can be easily separated from the support when the patterns are adhered to the adherend. Moreover, protrusion of the adhesive after adhering the electroformed patterns to the adherend can be inhibited. Still more, the formation of pinhole-like small electroformed products can be inhibited.

6 Claims, 7 Drawing Sheets

PROCESS FOR MANUFACTURING ELECTROFORMED PATTERNS

FIELD OF THE INVENTION

The present invention relates to a process for manufacturing electroformed patterns which comprises forming patterns such as letters for timepieces (watches, clocks, etc.) or ornamental parts by means of electroforming, transferring the patterns (electroformed patterns) onto a support such as a film and then adhering the patterns to an adherend such as a timepiece display plate.

BACKGROUND OF THE INVENTION

A process which has been predominantly used in recent years to manufacture patterns with extremely fine and complex shapes, e.g., letters for timepieces or ornamental parts, comprises forming a resist film on an area other than the pattern-forming area of a metallic plate surface to form conductive portions along the shapes of the patterns on the metallic plate surface, depositing metal on the conductive portions by means of electroforming to form electroformed patterns, temporarily transferring the electroformed patterns to a support such as a film with an adhesive to retain the patterns on the support, and again transferring the electroformed patterns to an adherend such as a timepiece display plate with an adhesive simultaneously with separating the patterns from the support.

For example, Japanese Patent Laid-Open Publication No. 16989/1984 (i.e., Japanese Patent Publication No. 18674/1988) discloses a process for manufacturing letters by means of electroforming which comprises forming a resist on a metallic plate, subjecting the metallic plate with the resist to electroforming, separating the electroformed product from the resist and the metallic plate by the use of a tape with a weak adhesive or other means, and applying an adhesive onto the separated surface of the electroformed product, wherein a disposable electroformed product provided in order to prevent excessive electroforming at the outer peripheral ends of the letters is used, prior to disposal, as a mask when the adhesive is applied to the letters.

In this process, however, the disposable electroformed product for use as a mask must be formed in a large area, and this results in increase of costs such as costs for electroforming materials and electric power and requirement of a long period of time for the electroforming.

Japanese Patent Laid-Open Publication No. 107496/1991 (i.e., Japanese Patent Publication No. 43988/1992) discloses a process for manufacturing electroformed patterns which comprises forming electroformed patterns and an electroformed line surrounding the electroformed patterns on a surface of a metallic plate, adhering a sheet coated with a weak adhesive to the metallic plate with the adhesive, peeling the sheet from metallic plate so as to separate the electroformed patterns and the electroformed line from the metallic plate, removing the electroformed line, covering other area than the electroformed pattern area with a mask having openings slightly larger than the electroformed patterns, and applying an adhesive to the electroformed patterns.

In this process, however, the adhesive (firmly bonding adhesive) is applied to the electroformed patterns after removal of the electroformed line, and therefore a large amount of the adhesive is applied to the peripheries of the electroformed patterns. As a result, the electroformed patterns are difficultly separated, or the adhesive is protruded out from the electroformed patterns after the patterns are adhered to an adherend, showing bad appearance. Further, in this process, pinhole-like small electroformed products are sometimes formed on area other than the electroformed patterns and electroformed lines, and the appearance of the adherend is spoiled by the small electroformed products.

OBJECT OF THE INVENTION

It is an object of the present invention to provide a process for manufacturing electroformed patterns by which the electroformed patterns can be manufactured at a low cost.

It is another object of the present invention to provide a process for manufacturing electroformed patterns in which the electroformed patterns can be easily separated from the support when the patterns are adhered to the adherend and protrusion of the adhesive after adhering the electroformed patterns to the adherend can be inhibited.

It is further object of the invention to prevent the formation of pinhole-like small electroformed products.

SUMMARY OF THE INVENTION

The above-mentioned objects have been attained by the first process for manufacturing electroformed patterns according to the invention, which comprises: forming electroformed patterns and an electroformed line surrounding said patterns on a surface of a conductive substrate; peeling the electroformed patterns and the electroformed line from the conductive substrate to transfer them onto a pressure-sensitive adhesive layer provided on a support; forming a firmly bonding adhesive layer on the whole surface of the side where the electroformed patterns and the electroformed line are retained; removing the electroformed line; and adhering the electroformed patterns to a surface of an adherend with the firmly bonding adhesive layer, simultaneously with separating the patterns from the support.

The conductive substrate is preferably a multi-layer substrate consisting of a metallic plate and a conductive thin film provided thereon. The pressure-sensitive adhesive layer is preferably composed of an ultraviolet-curing type pressure-sensitive adhesive.

According to the first process of the invention constructed as above, prior to forming the firmly bonding adhesive layer on the electroformed patterns, adhesive layer is formed on both the electroformed patterns and the electroformed line which surrounds said patterns, and then only the electroformed line is removed. Therefore, any adhesive does not remain in the vicinity of the electroformed patterns. As a result, the electroformed patterns can be easily separated from the support, and protrusion of the adhesive after adhering the electroformed patterns to the adherend can be inhibited.

The second process for manufacturing electroformed patterns according to the invention is characterized by comprising: forming electroformed patterns, an electroformed line surrounding said patterns and an electroformed island at area other than said electroformed patterns, and which is surrounded with said electroformed line and interliked thereto, on a surface of a conductive substrate; peeling the electroformed patterns, the electroformed line and the electroformed island from the conductive substrate to transfer them onto a pressure-sensitive adhesive layer provided on a support; forming a firmly bonding adhesive layer on the whole surface of the side where the electroformed patterns, the electroformed line and the electroformed island are retained; removing the electroformed line and electroformed island; and adhering the electroformed patterns to a surface of an adherend with the firmly bonding adhesive layer, simultaneously with separating the patterns from the support.

According to the second process for manufacturing electroformed patterns of the present invention, the formation of pinhole-like small electroformed products can be inhibited.

DETAILED DESCRIPTION OF THE INVENTION

First and second embodiments of the present invention will be described in detail hereinafter with reference to the attached drawings.

In the first embodiment, letters for timepieces are adhered as electroformed patterns to a surface of a timepiece display plate (adherend). However, this invention is in no way limited to manufacturing of the letters for timepieces, and can be applied to manufacturing of various ornamental letters, symbols, etc.

Figure 1:
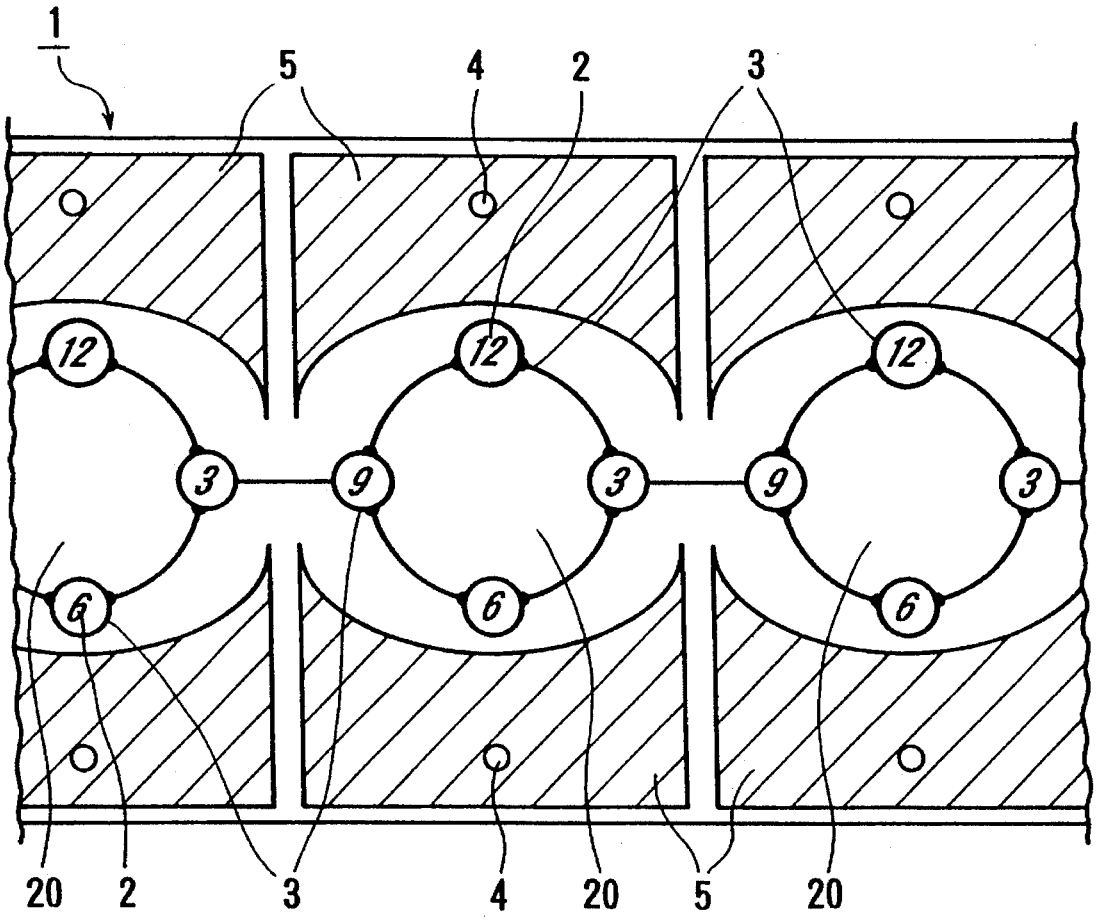
FIG. 1 is a plan view showing a state where electroformed patterns, an electroformed line and an electroformed guide are formed on a surface of a conductive substrate.

In the first place, as shown in FIG. 1, on a surface of a conductive substrate 1 are formed electroformed patterns 2 constituting letters (numerals) 3, 6, 9 and 12 for a timepiece, an electroformed line 3 which surrounds the electroformed patterns and an electroformed guide 5 which surrounds the electroformed patterns 2 and the electroformed line 3 and is provided with guide holes 4.

Figure 2:
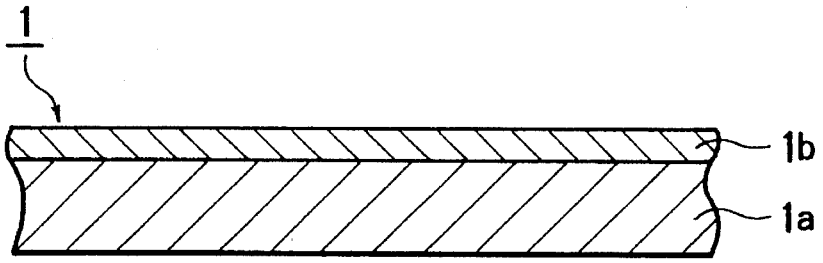
FIG. 2 is a sectional view showing an example of a conductive substrate (multi-layer substrate).

The conductive substrate 1 used herein is, for example, a metallic plate made of a stainless steel or a laminate consisting of a metallic plate 1*a* and a conductive film 1*b* provided on the surface the metallic plate (hereinafter also referred to as "multi-layer substrate 1") (see: FIG. 2). In the present invention, the multi-layer substrate having the conductive film 1*b* on the surface of the metallic plate la is preferably used as the conductive substrate 1. By the use of such a multi-layer substrate 1 as mentioned above, the electroformed patterns can be prevented from being scattered when the patterns are transferred to a support. In this embodiment, such a case that the multi-layer substrate 1 is used as the conductive substrate is described.

The conductive film 1*b* of the multi-layer substrate 1 is a flexible thin film having electrical conductivity. Employable as the conductive film 1*b* are conductive metallic thin films formed by electroplating (electrodeposition) or electroless plating, conductive paint films, conductive polymer thin films, etc. Of these, preferably used are conductive metallic thin films formed by electrodeposition. There is no specific limitation on the thickness of the conductive film 1*b*, but the film 1*b* has a thickness of usually about 10 to 50 μm, preferably about 20 to 30 μm.

The conductive film 1*b* is peeled off from the surface of the metallic plate 1*a* in the later stage. Therefore, the surface of the metallic plate 1*a* is preferably subjected to release treatment before the formation of the conductive film 1*b*, so as to facilitate peeling of the conductive film 1*b*. The release treatment can be carried out by, for example, oxidizing the surface of the metallic plate 1*a* through anode electrolysis or treating the surface of the metallic plate 1*a* with a surface active agent or the like.

Then, the electroformed patterns 2 and the electroformed line 3 surrounding the electroformed patterns 2 are formed on the surface of the conductive film 1*b*. A method to form the electroformed patterns 2 and the electroformed line 3 is described in detail in Japanese Patent Laid-Open Publication No. 107496/1991. There is no specific limitation on the method therefor. Described below is a method for forming the electroformed patterns 2 and the electroformed line 3 which is generally employed.

In this method, letters for a timepiece are adhered as the electroformed patterns to a surface of a timepiece display plate (adherend). First, a negative or positive photomask film 6 for desired electroformed patterns is produced by photographing or printing, as shown in FIG. 3.

Figure 3:
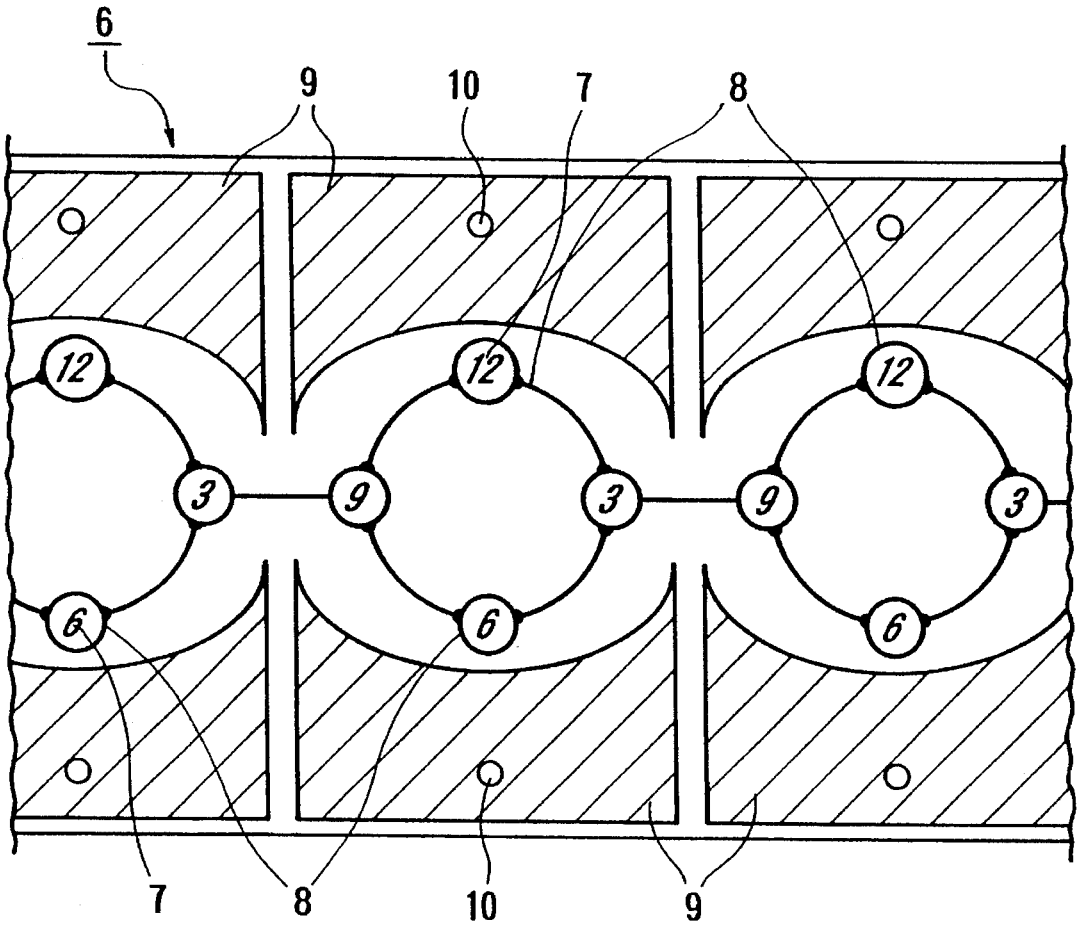
FIG. 3 is a plan view showing an example of a photomask film for electroformed patterns.

The photomask film 6 shown in FIG. 3 is a positive film. On the film 6, target patterns 7 constituting timepiece letters 3, 6, 9 and 12, a line 8 which surrounds the target patterns 7 and a guide area 9 of rectangular shape which surrounds the target patterns 7 and the line 8 (i.e., area with oblique lines in FIG. 3) are drawn with black ink or the like. At the predetermined positions inside the guide area 9, guide marks 10 are drawn with white circles. Though the width of the line 8 depends upon the shapes of the target patterns 7 and the sizes thereof, it is usually in the range of about 0.5 to 5 mm. The distance between the target patterns 7 and the line 8 is usually in the range of 0.3 to 0.5 mm.

Figure 4:
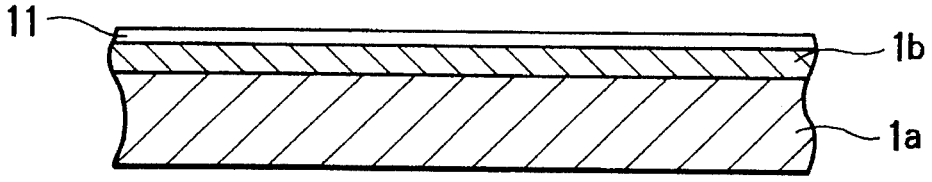
FIG. 4 is a sectional view showing a state where a photoresist is laminated on a surface of a conductive substrate.

Separately, the upper surface of the conductive film 1*b* of the multi-layer substrate is coated with a photoresist 11 such as a liquid resist, a dry film resist or a printing ink resist, as shown in. FIG. 4.

Figure 5:
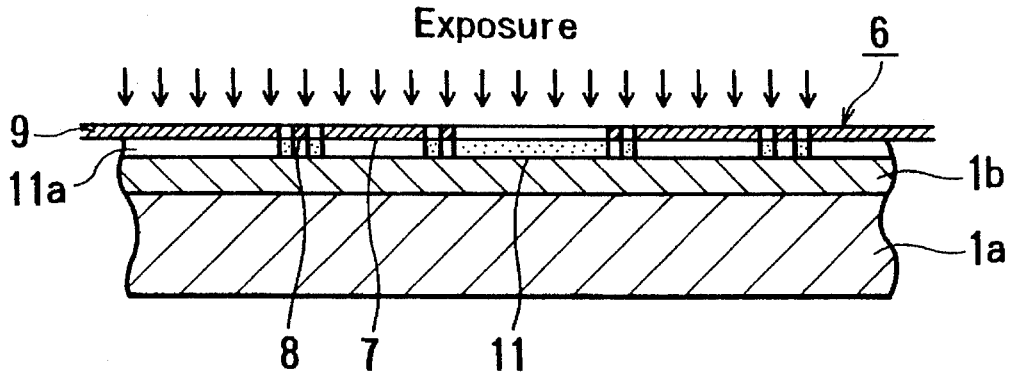
FIG. 5 is a sectional view showing a state where exposure is carried out.

Subsequently, on the conductive film 1*b* is placed the aforesaid film 6 in such a manner that the photoresist 11 is sandwiched therebetween, and they are exposed to light in this state by the use of an exposure machine, etc., as shown in FIG. 5. In this figure, the portions indicated by oblique lines in the film 6 correspond to the target patterns 7, the line 8 and the guide area 9, and block the light.

Figure 6:
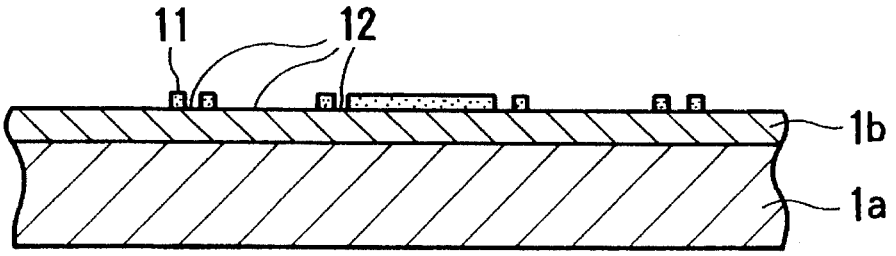
FIG. 6 is a sectional view showing a state where development is carried out after exposure.
Figure 7:
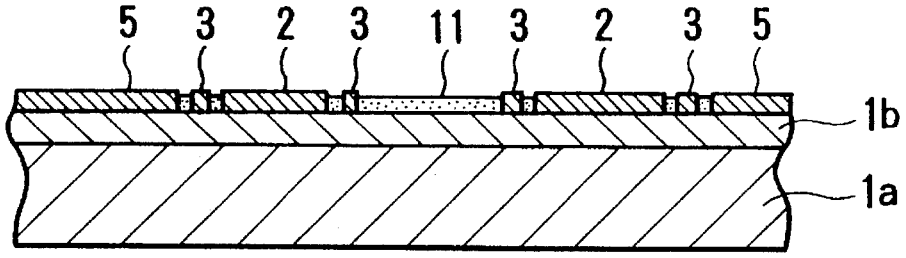
FIG. 7 is a sectional view showing a state where electroforming is carried out after development.

After the exposure, development is carried out to remove the unexposed photoresist 11*a* (see: FIG. 5), whereby conductive portions 12 (also referred to as "electroformed pattern-corresponding areas") having shapes corresponding to the shapes of the target patterns 7, the line 8 and the guide area 9 are formed on the surface of the conductive film 1*b*, as shown in FIG. 6. Then, if desired, the surfaces of the conductive portions 12 (electroformed pattern-corresponding areas) are subjected to release treatment. If the release treatment is conducted, electroformed patterns 2 and an electroformed line 3, both of which are produced later, can be easily separated from the conductive film 1*b*. This release treatment is carried out in the same manner as described above.

Then, metal is deposited on the conductive portions 12 by means of electroforming to form electroformed patterns 2 having shapes corresponding to the shapes of the target patterns 7, an electroformed line 3 having a shape corresponding to the shape of the line 8 and an electroformed guide 5 having a shape corresponding to the shape of the guide area 9. If the electroformed line 3 is formed on the periphery of the electroformed patterns 2 in this manner, the metal which is to be deposited on the area corresponding to the target patterns 7 can be distributed to the area corresponding to the line 8, and hence excessive electroforming for the target patterns 7 can be inhibited. In the case where the target patterns 7 have sharp shapes, metal is excessively deposited on the sharp portions, and thereby the resulting electroformed patterns tend to be rounded. According to the present invention, however, the electroformed line 3 is formed to inhibit excessive electroforming of the patterns 2, and hence electroformed patterns 2 of sharp shapes can be obtained.

The electroformed patterns 2 are numerals 3, 6, 9 and 12 when seen from the top, but in the drawings, only the widths of those numerals are drawn. Inside the electroformed guide 5, guide holes (not shown) each penetrating along the shape of the guide mark 10 are provided.

The metal for forming the electroformed patterns 2, the electroformed line 3 and the electroformed guide 5 is, for example, nickel. When nickel is used as the metal, nickel is electrodeposited on the conductive portions 12 by the use of a nickel sulfate solution as an electrolytic solution. The electrodeposition conditions are, for example, as follows. When an electric current of 3 A/dm$^2$ is allowed to supply based on the electrodeposition effective area of 150 mm×150 mm over a period of 3 hours to obtain an electroformed pattern of 100 μm±10 μm in thickness.

As a matter of course, any optional metals other than nickel, such as gold, silver, copper, iron, platinum and alloys thereof, can be deposited on the conductive portions to form the electroformed patterns. Further, the electrodeposition conditions can be varied, whereby electroformed patterns having a desired thickness in the range of 20 to 300 μm can be obtained.

Figure 8:
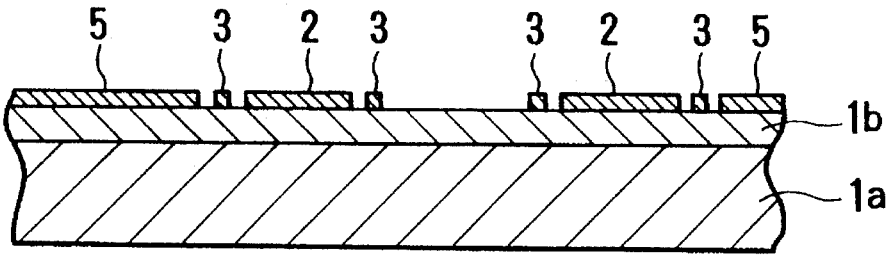
FIG. 8 is a sectional view showing a state where a photoresist is removed after electroforming.

In the next place, the photoresist 11 on the conductive film 1*b* is removed by immersing them in a stripping solution as shown in FIG. 8, whereby the electroformed patterns 2 constituting the timepiece letters 3, 6, 9 and 12, the electroformed line 3 which surrounds the electroformed patterns 2 and the electroformed guide 5 which surrounds the electroformed patterns 2 and the electroformed line 3 and is provided with guide holes 4 are formed on the surface of the conductive substrate 1, as shown in FIG. 1. If desired, the surfaces of the electroformed patterns 2 can be subjected to surface treatment such as metal plating or decoration (coloring) treatment such as electrodeposition painting, spray painting, printing, electrostatic painting and vacuum deposition.

Figure 9:
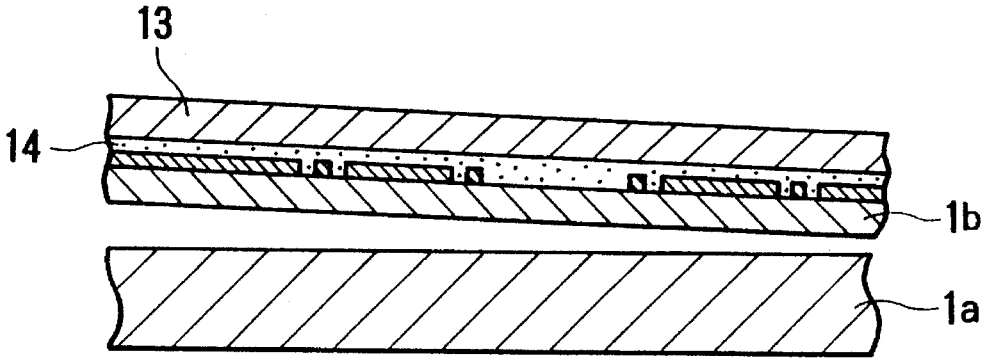
FIG. 9 is a sectional view showing a state where electroformed patterns are transferred to a support together with a conductive film and retained thereon.

After the electroformed patterns 2, the electroformed line 3 and the electroformed guide 5 are formed on the surface of the conductive substrate 1 by the electroforming as described above, these electroformed portions are transferred to a pressure-sensitive adhesive layer 14 of a support 13 such as a film as shown in FIG. 9. When the multi-layer substrate 1 is used, the electroformed patterns are formed on the conductive film 1*b*, and in this case, the conductive film 1*b* is peeled off simultaneously with the transferring of the electroformed patterns. In more detail, interfacial separation between the conductive film 1*b* and the metallic plate 1*a* is carried out, and the electroformed patterns are separated while the patterns are sandwiched between the conductive film 1*b* and the support 13. As a result, scattering of the electroformed patterns is inhibited, and thereby the electroformed patterns can be manufactured in high yields. Further, the electroformed patterns and the metallic plate can be released with almost no deformation. Therefore, any stress does not remain in the electroformed patterns and any deformation does not take place after adhesion of the patterns to the adherend. Moreover, there is such an advantage that the metallic plate can be subjected to repeated uses. If a film of high surface smoothness, e.g., electro-plate film (electro-deposit film) is used as the conductive film 1*b*, the resulting electroformed patterns have smooth back surfaces, and hence adhesion of the patterns to the adherend can be reliably carried out. Further, since the photoresist can be closely bonded to the conductive film 1*b* of high surface smoothness, occurrence of flash can be inhibited, and hence electroformed patterns of high quality can be obtained.

The pressure-sensitive adhesive layer 14 can be formed from various pressure-sensitive adhesives, for example, those of ultraviolet-curing type, thermosetting type and hardening-with-time type.

Typical examples of the pressure-sensitive adhesives of ultraviolet-curing type include rubber type pressure-sensitive adhesives compounded with addition-polymerizable compounds having two or more unsaturated bonds or photopolymerizable compounds such as alkoxysilane having epoxy group and photopolymerization initiators such as carbonyl compounds, organosulfur compounds, peroxides, amines and onium salt compounds; and acrylic type pressure-sensitive adhesives (see: Japanese Patent Laid-Open Publication No. 196956/1985). The photopolymerizable compound and the photopolymerization initiator are generally added in amounts of 10 to 500 parts by weight, and 0.1 to 20 parts by weight, respectively, each based on 100 parts by weight of the base polymer.

Examples of the acrylic type polymers used herein include those conventionally known (see: Japanese Patent Publications No. 54068/1982 and No. 33909/1983), those having radical reactive unsaturated group on the side chain (see: Japanese Patent Publication No. 56264/1986) and those having epoxy group in the molecule.

Examples of the addition-polymerizable compounds having two or more unsaturated bonds include polyhydric alcohol esters of acrylic acids and methacrylic acids, oligoesters of these acids, epoxy compounds and urethane compounds.

Epoxy group functional crosslinking agents having at least one epoxy group in the molecule, such as ethylene glycol diglycidyl ether, may be further added to increase crosslinking effect.

In the case where the pressure-sensitive adhesive layer 14 is formed by the use of the ultraviolet-curing type adhesive, it is necessary to use a transparent film as the support 13 so that the ultraviolet treatment can be performed.

Typical examples of the pressure-sensitive adhesives of thermosetting type include rubber type pressure-sensitive adhesives or acrylic type pressure-sensitive comprising crosslinking agents such as polyisocyanate, melamine resins, amine-epoxy resins, peroxides and metal chelate compounds; if desired, with crosslinking modifiers of polyfunctional compounds such as divinylbenzene, ethylene glycol diacrylate and trimethylolpropane trimethacrylate.

The pressure-sensitive adhesive of hardening-with-time type is, for example, an adhesive whose adhesive force is decreased by evaporation of the solvent with time.

Figure 10:
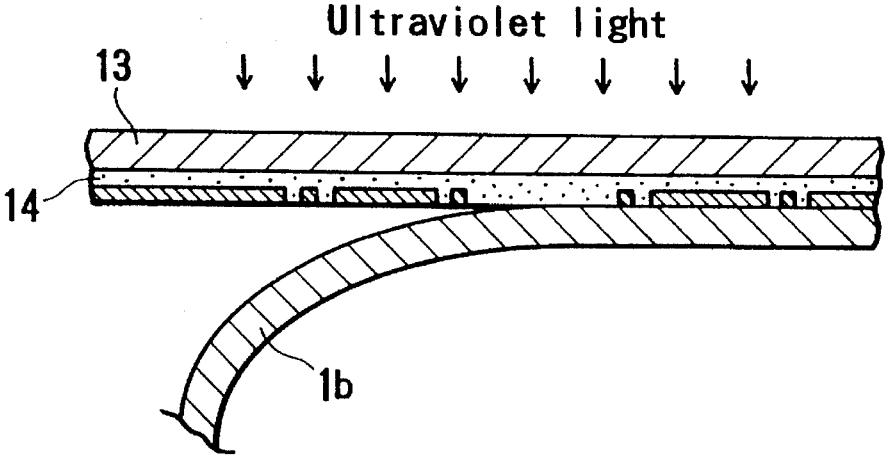
FIG. 10 is a sectional view showing a state where a conductive film is removed after irradiation with a small amount of ultraviolet light.

After the electroformed patterns (2, 3, 5), etc. are transferred together with the conductive thin film 1*b* on the pressure-sensitive adhesive layer 14 of the support 13, the conductive thin film 1*b* is removed to expose the electroformed patterns, etc. outside (this exposed surface is also referred to as "whole surface of the side where the electroformed patters, etc. are retained" hereinafter), as shown in FIG. 10. When the pressure-sensitive adhesive layer 14 is formed from the ultraviolet-curing type pressure-sensitive adhesive, it is preferred to decrease the adhesive force of the pressure-sensitive adhesive layer 14 by irradiating the adhesive layer 14 with a small amount of ultraviolet light prior to the removal of the conductive thin film 1*b*. Further, prior to the separation between the metallic plate 1*a* and the conductive thin film 1*b* (see: FIG. 9), the adhesive force of the pressure-sensitive adhesive layer 14 can be decreased. The adhesive force of the ultraviolet curing type pressure-sensitive adhesive is strong, i.e., 2,400 g/25 mm-width. Therefore, unless the adhesive force is decreased to a certain extent, the conductive thin film 1*b* is hardly separated from the pressure-sensitive adhesive layer 14. However, excessive decrease of the adhesive force of the ultraviolet-curing type adhesive layer is unfavorable, because the electroformed patterns are also peeled off when the conductive thin film 1*b* is removed. Accordingly, the adhesive force of the pressure-sensitive adhesive layer after the irradiation with ultraviolet light is desired to be in the range of about 300 to 600 g/25 mm-width, preferably about 400 to 500 g/25 mm-width.

Figure 11:
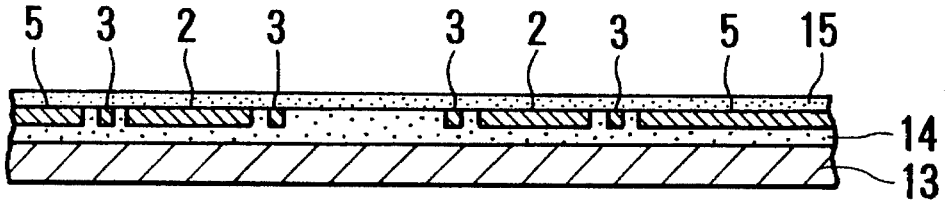
FIG. 11 is a sectional view showing a state where a firmly bonding adhesive layer is formed on the whole surface of the side where the electroformed patterns, the electroformed line and the electroformed guide are retained.
Figure 12:
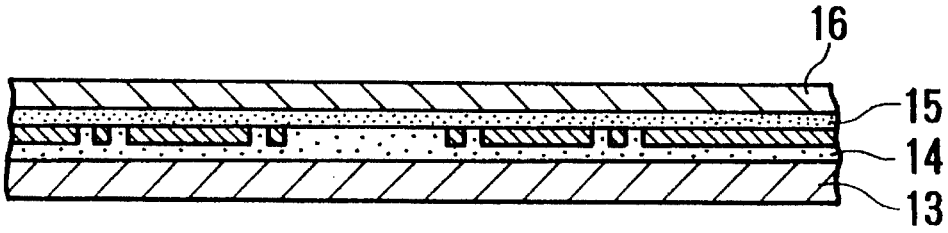
FIG. 12 is a sectional view showing a state where a release paper is attached to the firmly bonding adhesive layer.

Subsequently, as shown in FIG. 11, a firmly bonding adhesive layer 15 is formed on the whole surface of the side where the electroformed patterns 2, the electroformed line 3 and the electroformed guide 5 are retained. The firmly bonding adhesive layer preferably has an adhesive force higher than the pressure-sensitive adhesive layer 14. Thereafter, a release paper 16 is attached onto the firmly bonding adhesive layer 15 (see: FIG. 12). In this state, the adhesive force of the pressure-sensitive adhesive layer 14 is further decreased.

Figure 13:
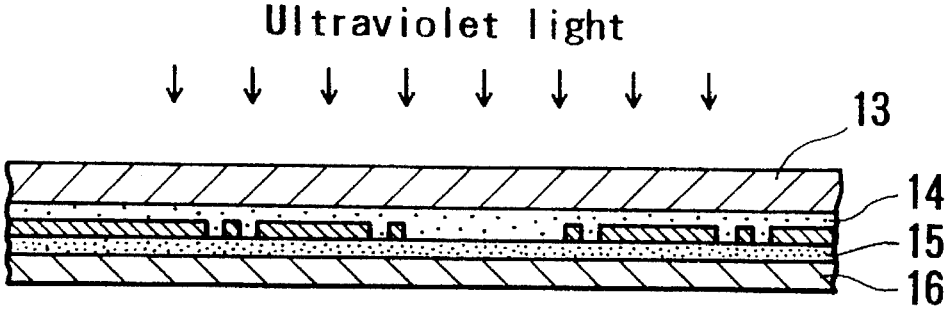
FIG. 13 is a sectional view showing a state where the adhesive force of a pressure-sensitive adhesive layer is decreased by means of irradiation with ultraviolet light.

In the case where the pressure-sensitive adhesive layer 14 is formed from the ultraviolet-curing type pressure-sensitive adhesive, after the release paper 16 is attached, the support 13 is irradiated with ultraviolet light from the surface side of the electroformed patterns, i.e., the opposite side to the side where the electroformed patterns are retained, as shown in FIG. 13, to alter the adhesive force of the pressure-sensitive adhesive layer 14 to extremely weak one.

In the case where the pressure-sensitive adhesive layer 14 is formed from the thermosetting type pressure-sensitive adhesive, the adhesive force of the pressure-sensitive adhesive layer 14 is altered to extremely weak one by heating the support 13. In the case where the pressure-sensitive adhesive layer 14 is formed from the hardening-with-time type pressure-sensitive adhesive, the adhesive force of the pressure-sensitive adhesive layer 14 is altered to extremely weak one by allowing the adhesive layer 14 to stand for a certain period of time.

It is desired that the adhesive force of the pressure-sensitive adhesive layer 14 is decreased to less than 100 g/25 mm-width, preferably about 30 to 50 g/25 mm-width, by the above treatment.

Figure 14:
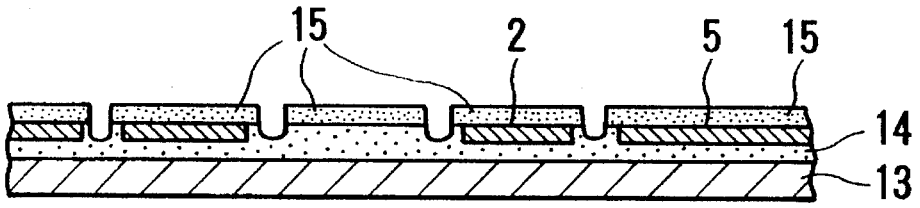
FIG. 14 is a sectional view showing a state where the electroformed line is removed.
Figure 15:
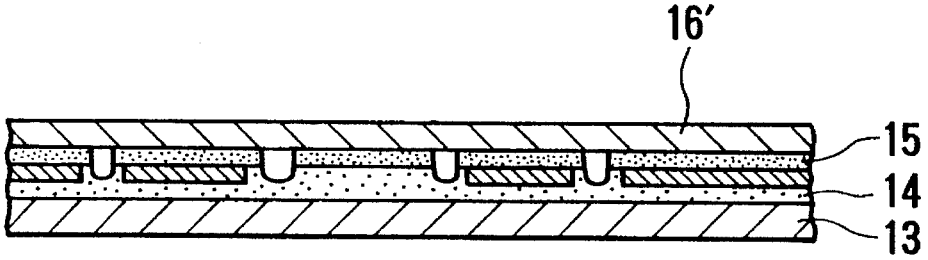
FIG. 15 is a sectional view showing a state where a release paper is attached to the firmly bonding adhesive layer after removal of the electroformed line.

Subsequently, the release paper 16 is removed. Then, the electroformed line 3 is removed, as shown in FIG. 14. The electroformed line 3 is a continuous line as shown in FIG. 1, and it can be removed at a time. As a result, the electroformed line 3 which is located near the electroformed patterns is removed together with the firmly bonding adhesive 15, and hence the firmly bonding adhesive hardly remains in the vicinity of the electroformed patterns. Accordingly, the electroformed patterns 2 can be easily separated from the support 13, and protrusion of the adhesive after adhering the electroformed patterns to the adherend can be inhibited. Unless the electroformed patterns are subjected to the immediate use, a release paper 16' is attached to the firmly bonding adhesive layer 15 side of the electroformed patterns as shown in FIG. 15, and the release paper 16' is peeled off before use.

Figure 16:
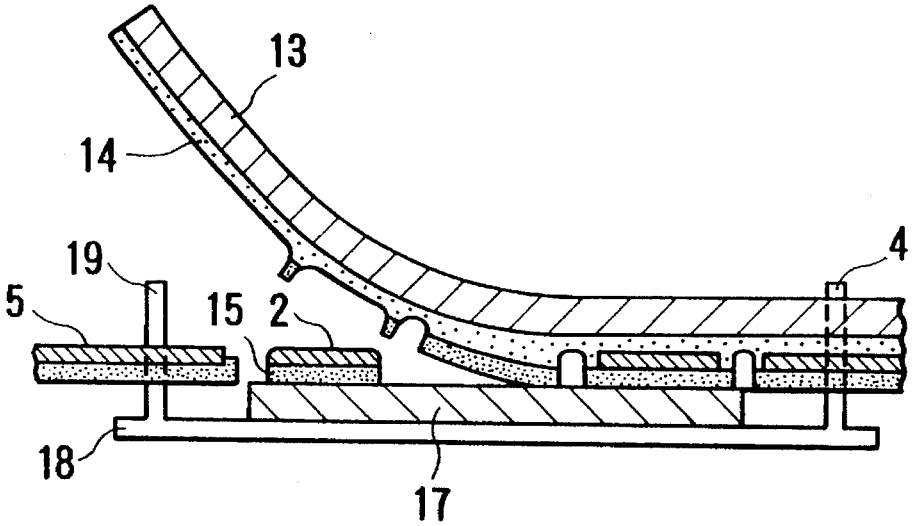
FIG. 16 is a sectional view showing a state where the electroformed patterns are transferred to an adherend simultaneously with separating the electroformed patterns from the support.

Then, as shown in FIG. 16, the electroformed patterns 2 are adhered to a surface of an adherend with the firmly bonding adhesive 15 coated on the electroformed patterns 2, simultaneously with separating the electroformed patterns 2 from the support 13.

Figure 17:
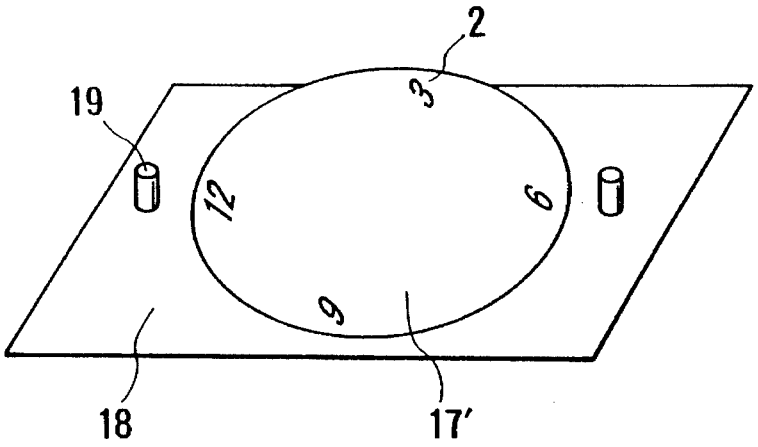
FIG. 17 is a perspective view showing an adherend to which the electroformed patterns are adhered.

As shown in FIGS. 16 to 17, a holding fixture 18 which holds a timepiece display plate 17' (i.e., adherend 17) is provided with guide pins 19 overhanging from the holding fixture. Owing to these guide pins 19 and the aforesaid guide holes 4 provided in the electroformed guide 5, positioning of the electroformed patterns on the timepiece display plate 17' can be carried out.

As described before, the adhesive force of the pressure-sensitive adhesive layer 14 is decreased. This is the same situation as the electroformed patterns 2 are held by a weak adhesive. Accordingly, the electroformed patterns 2 can be adhered to a surface of the timepiece display plate 17' (adherend) through the firmly bonding adhesive 15 applied onto the electroformed pattern-retention side, simultaneously with separating the electroformed patterns 2 from the support 13.

If both adhesives for the pressure-sensitive adhesive layer 14 and the firmly bonding adhesive layer 15 are selected so that the adhesive force at the interface between the pressure-sensitive adhesive layer 14 and the firmly bonding adhesive 15 is made larger than the adhesive force at the interface between the timepiece display plate 17' and the firmly bonding adhesive 15, it becomes possible that the firmly bonding adhesive 15 does not attach to the timepiece display plate 17'.

For example, if an acrylic type pressure-sensitive adhesive compounded with a photopolymerizable compound and a photopolymerization initiator is used as a pressure-sensitive adhesive for forming the pressure-sensitive adhesive layer 14, an adhesive similar to the pressure-sensitive adhesive for the pressure-sensitive adhesive layer 14 but compounded with no photopolymerizable compound and no photopolymerization initiator, i.e., an acrylic type pressure-sensitive adhesive composed of only an acrylic base polymer, is selected as the firmly bonding adhesive 15. After application of the firmly bonding adhesive of this type, the adhesive is aged at 40° C. for 9 hours, whereby the adhesive force at the interface between the pressure-sensitive adhesive layer 14 and the firmly bonding adhesive 15 can be made larger than the adhesive force at the interface between the timepiece display plate 17' and the firmly bonding adhesive 15. Hence, the unnecessary adhesive, i.e., adhesive on the area other than the bonding area, can be completely removed. If both the adhesives are selected so that the bonding force at the interface between the pressure-sensitive adhesive layer 14 having been reduced in the adhesion and the firmly bonding adhesive 15 is made larger than the bonding force at the interface between the adherend 17 and the firmly bonding adhesive 15 as described above, such a troublesome operation as coating the firmly bonding adhesive 15 only the back surfaces of the electroformed patterns with the adhesive can be omitted. As a result, the process can be simplified.

In the present invention, the adhesive may be coated or sprayed through a mask having openings slightly larger than the electroformed patterns 2 in the formation of the firmly bonding adhesive layer 15, whereby the firmly bonding adhesive layer 15 can be formed on only the back surfaces of the electroformed patterns 2.

Hereinbefore, the first embodiment of the present invention is illustrated with referring to the manufacturing method of a timepiece display plate. By the way, the timepiece display plate has a large blank portion at a center thereof (wherein the term "blank portion" means the portion surrounded by the electroformed line 3 but the area other than the electroformed patterns 2, and is indicated by "20" in FIG. 1). However, if the photoresist corresponding to the blank portion 20 (for example, indicated by "11" as in FIG. 5) has a pinhole, the electroformed product is deposited at the pinhole to form a small electroformed product at the blank portion 20. When such the small electroformed product is transformed to the timepiece display plate, the appearance thereof is markedly spoiled.

Figure 18:
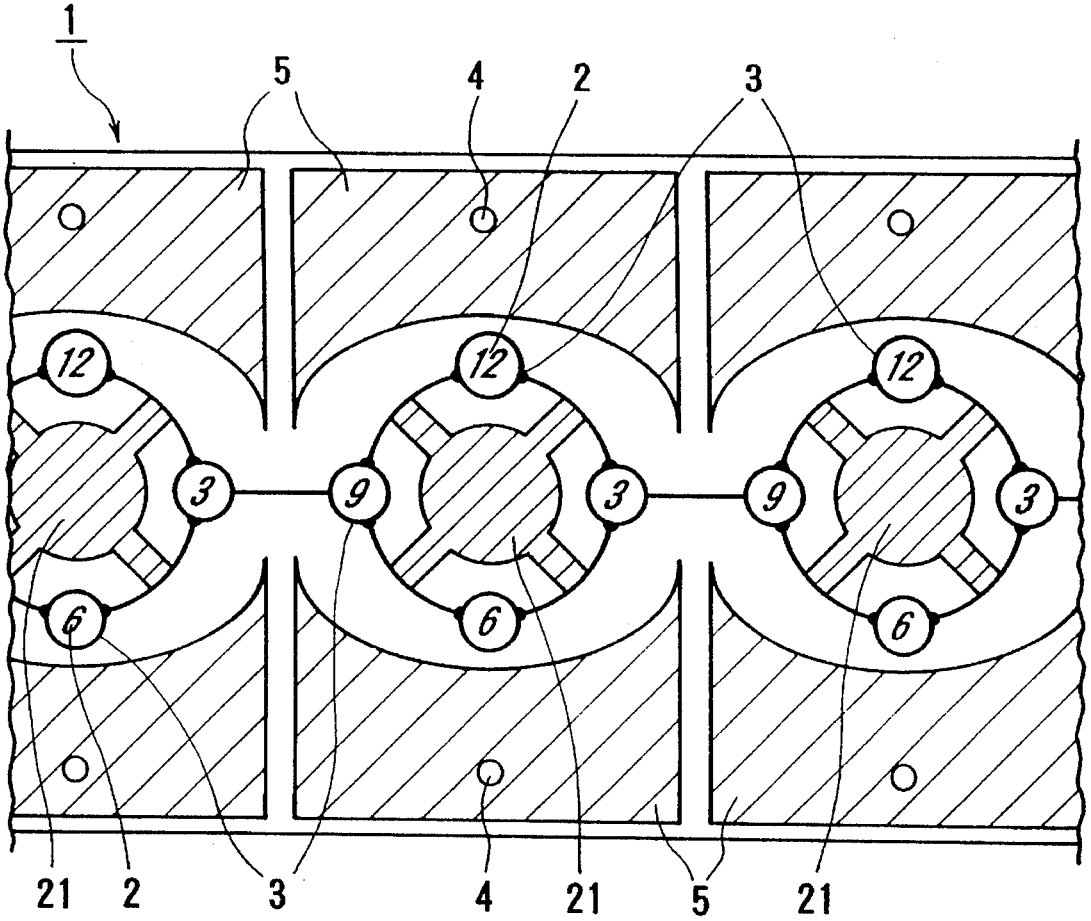
FIG. 18 is a plan view showing a state where electroformed patterns, an electroformed line, an electroformed guide and an electroformed island are formed on a surface of a conductive substrate.

The second process for manufacturing electroformed patterns according to the present invention is intended to inhibit the formation of small electroformed products at the blank portion 20. The second embodiment of the present invention is similar to the first embodiment except for forming an electroformed island 21 at the blank portion 20 (see FIG. 18). The electroformed island 21 is interlinked with the electroformed line 3, surrounded by the electroformed line 3, and formed at portion other than the electroformed patterns 2.

The electroformed island 21 is formed at center of the blank portion 20, and desirably formed at an area ratio of 40% to 70%, preferably 50% to 60%, based on the whole area of the blank portion 20.

The second process for manufacturing electroformed patterns according to the invention comprises the steps of:

forming electroformed patterns 2, the electroformed line 3 and the electroformed island 21 on the surface of the conductive substrate 1;

peeling the electroformed patterns 2, the electroformed line 3 and the electroformed island 21 from the conductive substrate 1 to transfer them onto a pressure-sensitive adhesive layer 14 provided on a support 13;

forming a firmly bonding adhesive layer 15 on the whole surface of the side where the electroformed patterns 2, the electroformed line 3 and the electroformed island 21 are retained;

removing the electroformed line 3 and electroformed island 21; and adhering the electroformed patterns 2 to a surface of an adherend 17 with the firmly bonding adhesive layer 15, simultaneously with separating the electroformed patterns 2 from the support 13.

By forming such the electroformed island 21, the formation of small electroformed products can be inhibited. Further, the electroformed island 21 is interlinked with the electroformed line 3, and hence the electroformed island 21 is readily removed together with the electroformed line 3. Furthermore, strength of the electroformed line 3 is increased by the electroformed island 21, and hence cutting-off of the electroformed line 3 is inhibited when removing the electroformed line 3.

EFFECT OF THE INVENTION

According to the present invention, the electroformed patterns can be manufactured at a low cost. Further, when the electroformed patterns are adhered to an adherend, the patterns can be easily separated from the support, and protrusion of the adhesive after adhering the electroformed patterns to the adherend can be inhibited. Moreover, according to the present invention, the formation of pinhole-like small electroformed products can be inhibited.

What is claimed is:

1. A process for manufacturing electroformed patterns, comprising:

forming electroformed patterns and an electroformed line surrounding said patterns on a surface of a conductive substrate, peeling the electroformed patterns and the electroformed line from the conductive substrate to transfer them onto a pressure-sensitive first adhesive layer provided on a support, forming a firmly bonding second adhesive layer on a whole surface of a side of the electroformed patterns and the electroformed line opposite the first adhesive layer, removing the electroformed line, and adhering the electroformed patterns to a surface of an adherend through the firmly bonding second adhesive layer, simultaneously with separating the electroformed patterns from the support.

2. A process for manufacturing electroformed patterns, comprising:

forming electroformed patterns, an electroformed line surrounding said patterns, an electroformed island at an area other than said electroformed patterns which is surrounded with said electroformed line and interlinked thereto, on a surface of a conductive substrate, peeling the electroformed patterns, the electroformed line and the electroformed island from the conductive substrate to transfer them onto a pressure-sensitive first adhesive layer provided on a support, forming a firmly bonding second adhesive layer on a whole surface of a side of the electroformed patterns, the electroformed line and the electroformed island opposite the first adhesive layer, removing the electroformed line and electroformed island, and adhering the electroformed patterns to a surface of an adherend by the firmly bonding second adhesive layer, simultaneously with separating the electroformed patterns from the support.

3. The process for manufacturing electroformed patterns as claimed in claim 1, wherein the conductive substrate comprises a metallic plate and a conductive thin film provided thereon and wherein the conductive thin film is peeled off of the metallic plate when the electroformed patterns are removed.

4. The process for manufacturing electroformed patterns as claimed in claim 1, wherein the pressure-sensitive adhesive layer comprises an ultraviolet-curing pressure-sensitive adhesive.

5. The process for manufacturing electroformed patterns as claimed in claim 2, wherein the conductive substrate comprises a metallic plate and a conductive thin film provided thereon and wherein the conductive thin film is peeled off of the metallic plate when the electroformed patterns are removed.

6. The process for manufacturing electroformed patterns as claimed in claim 2, wherein the pressure-sensitive adhesive layer comprises an ultraviolet-curing pressure-sensitive adhesive.

* * * * *